United States Patent [19]

Ottley

[11] Patent Number: 4,563,080

[45] Date of Patent: Jan. 7, 1986

[54] ELECTROPHOTOGRAPHIC LIQUID DEVELOPING APPARATUS AND METHOD

[75] Inventor: Thomas W. Ottley, Orwell, England

[73] Assignee: P.A. Management Consultants Limited, London, England

[21] Appl. No.: 589,095

[22] PCT Filed: May 19, 1983

[86] PCT No.: PCT/GB83/00142

§ 371 Date: Jan. 16, 1984

§ 102(e) Date: Jan. 16, 1984

[87] PCT Pub. No.: WO83/04113

PCT Pub. Date: Nov. 24, 1983

[30] Foreign Application Priority Data

May 19, 1982 [GB] United Kingdom ..... 8214631

[51] Int. Cl.[4] ..... G03G 15/10

[52] U.S. Cl. ..... 355/10; 118/659; 118/647

[58] Field of Search ..... 355/10; 118/659, 662, 118/638, 647

[56] References Cited

U.S. PATENT DOCUMENTS 3,802,388 4/1974 La Poma .
3,964,436 6/1976 Plumadore ..... 118/647
4,044,718 8/1977 Blake .
4,076,406 2/1978 Talmage et al. ..... 355/10
4,133,906 1/1979 Kuehnle ..... 118/659
4,141,647 2/1979 Lempke et al. ..... 355/10
4,265,996 9/1981 Simm et al. ..... 118/659

OTHER PUBLICATIONS

Xerox Disclosure Journal, vol. 5, No. 3, May–Jun. 1980, article by P. H. Kondo entitled: "Liquid Development Apparatus", pp. 283–284.

*Primary Examiner*—Arthur T. Grimley
*Assistant Examiner*—David Warren
*Attorney, Agent, or Firm*—Merchant, Gould, Smith, Edell, Welter & Schmidt

[57] ABSTRACT

A method of applying liquid toner to a predetermined part (4,5) of an electrophotographic film (1) is disclosed. The film is supported at a predetermined distance from an electrode (25) having a toner supply orifice (7). A predetermined quantity of liquid toner (13) is delivered, preferably by a metering cylinder (10) and piston (19) disposed between two valves (9,11), to the orifice (7). The quantity is such that surface tension forces retain the liquid toner in the desired region (24).

A method of processing an electrostatic image is also disclosed, as well as an assembly for applying liquid toner. The latter is preferably electrode (25) positioned in a recess in a support surface (3) for the film (1) to be processed.

18 Claims, 1 Drawing Figure

ELECTROPHOTOGRAPHIC LIQUID DEVELOPING APPARATUS AND METHOD

BACKGROUND OF THE INVENTION

This invention relates to electrophotography and more particularly is concerned with the application of liquid toner to an electrostatic image and to the processing of electrostatic images using liquid toner.

There are a number of difficulties in the satisfactory application and removal of liquid toner; disadvantages of known systems include:

(a) waste of toner which causes both unnecessary purchase of expensive toner and unnecessary labour in the dirty task of replenishing the machine with fresh toner;

(b) non-uniformity of toning over the area being processed;

(c) traps in the toner feed path in which toner may move only slowly, which may permit changes in the properties of the slow moving toner relative to that which is delivered quickly, which again causes non-uniformity in toning; and (d) failure to remove liquid toner completely before fusing from areas which should be clear, thus leading to grey or speckled areas in the eventual image which should be white.

The present invention aims to alleviate or ameliorate these difficulties, and is especially applicable to making copies which require very fine detail, for example in producing miniature or micro-copies and especially when copying onto TEP film (transparent electrophotographic film) such as the TEP materials supplied commercially by James River Graphics of Massachussetts, United States, Kodak, and others. The invention is also applicable to any other electrophotographic process and electrophotographic equipment using liquid toner. The invention is also of particular value when up-dating is carried out, i.e., when a piece of material receives an image covering less than its whole area, that image is developed and may be viewed, and at a later time the image-carrying material is re-exposed and processed to receive an additional image. In these circumstances, it is important that the exposure and processing of the first image have a negligible effect on that part of the image-receiving material which will later receive another image, and likewise that the exposure and processing of the second image have a negligible effect on the first image.

SUMMARY OF THE INVENTION

According to one aspect of the present invention, there is provided a method of applying liquid toner to a predetermined part of an electrophotographic film, which comprises:

(1) supporting the electrophotographic film at a predetermined distance from an electrode having a flat surface with a toner supply orifice therein, such that the predetermined part of the electrophotographic film is adjacent to said flat surface of the electrode; and (2) delivering a predetermined quantity of liquid toner through said toner supply orifice so as to form a region of toner between, and in contact with, (a) the electrode and (b) the predetermined part of the electrophotographic film, the quantity of liquid toner deilvered being such that the region of toner between the electrode and the electrophotographic film is retained in position by surface tension forces.

According to a second aspect of the invention, there is provided a method of processing an electrostatic image in a predetermined part of an electrophotographic film, which comprises:

(1) supporting the electrophotographic film at a predetermined distance from an electrode having a flat surface with a toner supply orifice therein such that the predetermined part of the electrophotographic film is adjacent to said flat surface of the electrode;

(2) delivering a predetermined quantity of liquid toner through said toner supply orifice so as to form a region of liquid toner between, and in contact with, (a) the electrode and (b) the predetermined part of the electrophotographic film, the quantity of liquid toner delivered being such that toner is retained in said region between the electrode and the electrophotographic film by surface tension forces; and (3) removing the toner from said region after effecting development of the electrostatic image.

The electrophotographic film is preferably supported at a distance in the range from 0.01 to 2.00 mm, more preferably from 0.2 to 1.0 mm, from said electrode surface. The electrode is advantageously formed with a single toner supply orifice, which is preferably circular in form; alternatively, the electrode can be formed with a plurality of toner supply orifices, which may for example be constituted by a plurality of small apertures arranged in a closely pitched linear array on the electrode surface. Generally, the toner supply orifice or the group of orifices will be positioned centrally in the flat surface of the electrode.

Toner is preferably supplied to the toner supply orifice via a flow channel which incorporates a metering cylinder, the arrangement being such that a predetermined quantity of toner is delivered by moving a piston within said metering cylinder. Conveniently, such a metering cylinder can be positioned between two valves. Flow of liquid toner into the region between the electrode surface and the surface of the electrophotographic film is preferably effected at a flow rate sufficiently low to minimise turbulence during ingress of the liquid toner.

In preferred embodiments of the second aspect of the invention, the electrostatic image is processed while liquid toner is held in said region, by the steps of:

(1) holding said electrode surface at a first electrical potential which is equal to or slightly less than that of the exposed parts of the image area of the electrophotographic film;

(2) increasing the electrical potential of said electrode surface to a second potential which is greater than the potential of said exposed parts of the image area of the electrophotographic film but less than that of unexposed parts of the electrophotographic film, and maintaining said electrode surface at said second potential for a predetermined time; and (3) thereafter reducing the electrical potential of said electrode surface to a value substantially the same as that of said first potential.

In the second aspect of the invention, spent toner may be removed from the region between the electrode surface and the electrophotographic film via the toner supply orifice. The flow channel for removal of spent toner preferably also includes a restricted orifice which is of a size such as to reduce the toner flow rate sufficiently to minimise turbulence in the toner as it is being withdrawn. Removal of spent toner is preferably effected by suction, e.g., through the agency of a vacuum pump.

According to a third aspect of the invention, there is provided an assembly for the application of a liquid toner to an electrostatic image, which comprises an electrode having a flat surface formed with a toner supply orifice; means for supplying a predetermined quantity of liquid toner through said toner supply orifice; and means for removing toner via said toner supply orifice.

An assembly in accordance with the present invention is preferably constructed so that the electrode is bounded by flow channels which allow air to flow into and out of the region which contains liquid toner when toner passes through the toner supply orifice. Also, the flat surface of the electrode is preferably constituted by a replaceable layer which is applied to the main body of the electrode. In this way, if the surface layer of the electrode becomes worn or defective due to adherence of toner particles, it may be removed and a fresh surface layer applied in its place.

The electrode in an assembly in accordance with the invention is preferably formed or provided with a toner supply channel through which liquid toner can be pumped to said toner supply orifice, the toner supply channel including two valves having between them a metering cylinder and piston.

According to a fourth aspect of the present invention, there is provided apparatus for processing an electrostatic image, which comprises a support surface for an electrophotographic film which is to be processed, and an assembly for the application of a liquid toner as hereinbefore described. In such apparatus, the toner assembly is preferably positioned in a recess formed in the support surface, so that a film supported by the surface will be held apart from the flat surface of the electrode by a distance which is the range from 0.2 to 1.0 mm.

BRIEF DESCRIPTION OF THE DRAWING

For a better understanding of the invention and to show how the same may be carried into effect, reference will now be made, by way of example, to the accompanying drawing, which shows a cross-sectional view through an assembly in accordance with the invention.

DETAILED DESCRIPTION OF THE DRAWING

Figure 1:
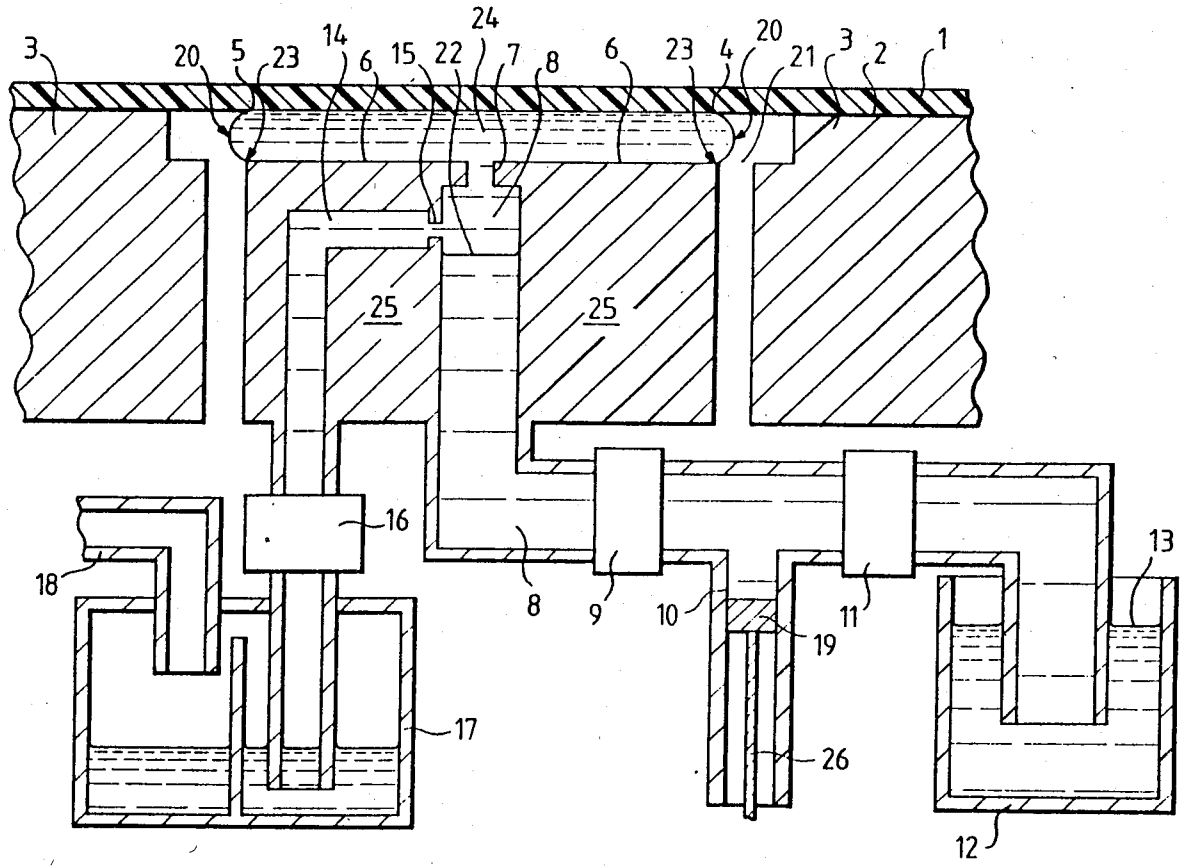

Referring to the drawing, there is shown a TEP film 1 which is resting in contact with a support surface 3 at a processing station including a toning assembly in accordance with this invention. As shown in the drawing, a predetermined area of the TEP film is undergoing processing. The predetermined area is that between the points 4 and 5; this area has been charged and exposed to form an electrostatic image on the sensitive surface 2 between the points 4 and 5. The rest of the film 1 may hold previously formed images, or it may be unexposed.

The toning assembly comprises an electrode 25 having a flat, rectangular top surface 6 which is bounded by edges 23 having a very small radius of curvature or chamfer. Edges 23 are thus relatively sharp, and enable the formation of a meniscus 20 which retains the liquid toner within region 24 as shown. The flat surface 6 of electrode 25 is positioned exactly parallel to the image-carrying surface 2 of the TEP film 1. Surface 6 is provided with means (not shown) for connecting the surface to a source of electrical potential.

At the centre of surface 6 there is a single, circular toner supply orifice 7. Orifice 7 leads to a toner feed pipe 8 which extends out of the main body of electrode 25 and leads to a reservoir 12 of liquid toner 13. Valves 9 and 11 are interposed in toner feed pipe 8 between the orifice 7 and the reservoir 12. Between the valves 9 and 11 there is a metering cylinder 10 within which there is a metering piston 19 carried on a rod 26. The head of piston 19 makes a close fit with the walls of cylinder 10.

At a position relatively close to toner supply orifice 7, the toner feed pipe 8 is formed with a branch conduit 14 which is connected to the main body of pipe 8 via a restricted orifice 15. The branch conduit 14 leads via a valve 16 to a toner trap 17. Trap 17 is connected via pipe 18 to a vacuum pump (not shown).

An air space 21 is provided around the body of electrode 25. The curved line 22 represents the level of the toner meniscus at a different point in the opening cycle of the assembly, as will be explained later.

In operation, the assembly as illustrated in the drawing operates by pumping a metered quantity of liquid toner into the region 24 where it remains for a time sufficient to allow the necessary image processing steps to be completed. Thereafter, liquid toner is removed via orifices 7 and 15 to the trap 17. The metering cylinder 10 serves to extract toner from reservoir 12 and to pump toner into the region 24, while the vacuum pump (not shown) connected to branch conduit 14 through pipe 18 and trap 17 provides the suction necessary to remove liquid toner from region 24 after processing of the predetermined area of the TEP film has been completed.

The operating sequence of the assembly shown in the drawing will now be described in greater detail. When the toning assembly is first to be used, it is necessary to ensure that liquid toner is present in toner feed pipe 8 up to the level of meniscus 22. Ordinarily, this will be achieved automatically as a result of the completion of a previous toning operation, as will be described hereinafter. If necessary, e.g. when the assembly is to be used for the first time, the toner feed pipe 8 can be primed with toner to the level of meniscus 22 by any appropriate means, for example by a sequence of operations as follows:

Starting with valves 9, 11 and 16 closed, and with piston 19 fully extended (i.e. in the upward direction towards orifice 7 as shown in the drawing), valve 11 is first opened and piston 19 is retracted, thus drawing toner 13 from reservoir 12 through valve 11 and into the space between valves 9 and 11. Valve 11 is then closed, and valve 9 is opened. Thereafter, piston 19 is extended so as to expel some of the toner through valve 9 into the upstream part of toner feed pipe 8. Valve 9 is then closed, valve 11 is opened and piston 19 is retracted in order to replenish the space between valve 9 and 11 with further toner. Valve 11 is then closed, valve 9 is opened, and piston 19 is extended to raise the level of toner in the upper part of toner feed pipe 8. This sequence is continued until the toner reaches the level of meniscus 22.

When this condition is reached, the assembly is ready to process an image occupying a predetermined part of a TEP film 1. The film is supported as shown in the drawing, valves 9, 11 and 16 all being closed and piston 19 being retracted, at this stage. Valve 9 is then opened, and piston 19 is advanced by a predetermined amount to the position shown in the drawing. This action pumps a precise volume of toner towards the orifice 7; part of this volume of toner passes through the orifice 7 and fills the space 24 between the surface 6 of electrode 25 and the surface region 4,5 of film 1. The size of orifice 7 and the rate of movement of piston 19 are selected so that movement of toner through the orifice 7 is smooth and without turbulence. When the liquid toner reaches the boundary edges of electrode 25, the sharp edges 23 limit the spread of the toner, so that a meniscus 20 is formed and surface tension forces retain the liquid toner within the region 24. The dimensions of metering cylinder 10 and the stroke of piston 19 are selected to ensure that precisely the correct volume of liquid toner is supplied to region 24. If too little toner is supplied, then there would be inadequate wetting of the region 4,5 of the TEP film 1 which is to be processed; while if too much liquid toner were supplied, surface tension forces would not be able to maintain the two menisci 20, with the result that liquid toner would extend into air passages 21 and would go beyond the predetermined limit 4,5 of the film 1. As the toner enters the region 24, it displaces air which is able to escape via the air passages 21 which completely surround the top surface 6 of electrode 25.

During delivery of liquid toner to the region 24, an electrical potential (voltage) is applied to flat surface 6 of electrode 25 the value of the potential being equal to or slightly less than that of exposed parts of the image lying between points 4 and 5 on the surface 2 of the TEP film 1. When the toner delivery is completed, the voltage applied to surface 6 is increased so that the electrical potential at this surface reaches a second value which is intermediate the potential of exposed areas in the image being processed and that of unexposed areas of the film 1. After sufficient time for the toning process to take place the voltage applied to surface 6 is reduced to a value equal to, or approximating to, the first potential.

Valve 9 is then closed, and valve 16 is opened, resulting in extraction of spent toner from region 24 via orifices 7 and 15 into branch conduit 14, and thence through valve 16 and into trap 17. Spent toner can be collected from trap 17 by any convenient means for subsequent disposal. The purpose of orifice 15 is to limit the speed at which the toner is withdrawn from the region 24. In order to prevent liquid droplets remaining on the surface 2 of the TEP film 1, the flow of liquid toner away from the film should be laminar and turbulence should be minimised. Nevertheless, withdrawal of spent toner can be achieved rapidly with satisfactory results, and the level of toner in toner feed pipe 8 is reduced to that of the meniscus 22. It will be appreciated that flow rates are important both during supply and withdrawal of toner; when flow rates are correctly adjusted, the region 24 can be filled uniformly with liquid toner which is free from air bubbles, and when spent toner is withdrawn, practically all of the toner is swept away from surface 2 of film 1 by the retreat of the menisci 20. During withdrawal of spent toner, air enters the region 24 from the flow passages 21 with substantially laminar flow and does not disturb the smooth withdrawal of the toner. After the bulk of the toner has passed through orifices 7 and 15, the effect of orifice 15 in limiting the flow rate is greatly reduced, so that a more powerful suction effect is exerted on the surfaces which bound the region 24. As a result, any droplets of liquid toner remaining on the surface 6 of electrode 25 or on the surface region 4,5 of film 1 are sucked away, and any remaining trace of the liquid phase of the toner is evaporated. Valve 16 is then closed, valve 11 is opened, piston 19 is withdrawn through its controlled stroke thus drawing up fresh toner 13 from reservoir 12, and valve 11 is then closed. The apparatus is then ready for a further processing cycle.

In the embodiment illustrated in the drawing, the TEP film was a commercially available film manufactured and sold by James River Graphics of Massachussetts, United States. The liquid toner used was Kodak toner MX 1125. The separation between surface 6 and film 1 was 0.5 mm, and the dimensions of surface 6 were 16 mm×4.5 mm. The metering cylinder 10 and piston 19 were adjusted so that the stroke of piston 19 delivered a volume of 50 microliters of liquid toner. Of this, 36 microliters occupied the region 24, while the remaining 14 microliters occupied the volume bounded by orifices 7 and 15 and meniscus 22. In forming an electrostatic image on film 1, the TEP film is first charged to 1200 V and is then subject to imagewise exposure. After exposure, the irradiated parts of the image are at an electrical potential of 500 V. Surface 6 is initially held at a first potential which is within the range 400–500 V, and after the liquid toner has filled the region 24, surface 6 is raised to a second potential in the region of 700–800 V. The surface is held at this second potential for about one second to enable the toning process to be completed, and is then reduced once again to a value in the range 400–500 V before the spent toner is withdrawn.

It will be appreciated that, when the film 1 carries previously generated images outside the region 4,5, it is not necessary to restrict the application of charge to the surface of the film to the region 4,5 only; the whole surface of the TEP film may be charged without degrading the previously formed image(s).

I claim:

1. A method of applying liquid toner to a predetermined part of an electrophotographic film, which comprises:

(1) supporting on a support means the electrophotographic film at a predetermined distance from an electrode having a flat surface defining a toner supply orifice, such that the predetermined part of the electrophotographic film is adjacent to said flat surface of the electrode and such that the support means is in contact with the electrophotographic film at regions spaced from said predetermined part; and (2) delivering a predetermined quantity of liquid toner through said toner supply orifice so as to form a region of toner between, and in contact with, (a) the electrode and (b) the predetermined part of the electrophotographic film, the quantity of liquid toner delivered being such that the region of toner between the electrode and the electrophotographic film is retained, by surface tension, in position over said predetermined part and out of contact with said support means.

2. A method of processing an electrostatic image in a predetermined part of an electrophotographic film, which comprises:

(1) supporting on a support means the electrophotographic film at a predetermined distance from an electrode having a flat surface defining a toner supply orifice such that the predetermined part of the electrophotographic film is adjacent to said flat surface of the electrode and such that the support means is in contact with the electrophotographic film at regions spaced from said predetermined part;

(2) delivering a predetermined quantity of liquid toner through said toner supply orifice so as to form a region of liquid toner between, and in contact with, (a) the electrode and (b) the predetermined part of the electrophotographic film, the quantity of liquid toner delivered being such taht toner is retained in said region between the electrode and the electrophotographic film by surface tension forces and out of contact with said support means; and (3) removing the toner from said region after effecting development of the electrostatic image.

3. A method according to claim 2, in which the electrostatic image is processed, while liquid toner is held in said region, by the steps of:

(1) holding said electrode surface at a first electrical potential which is equal to or slightly less than that of the exposed parts of the image area of the electrophotographic film;

(2) increasing the electrical potential of said electrode surface to a second potential which is greater than the potential of said exposed parts of the image area of the electrophotographic film but less than that of unexposed parts of the electrophotographic film, and maintaining said electrode surface at said second potential for a predetermined time; and (3) thereafter reducing the electrical potential of said electrode surface to a value substantially the same as that of said first potential.

4. A method according to claim 2 wherein the toner is removed from said region via the toner supply orifice.

5. A method according to claim 4, wherein toner is removed through a flow channel which includes said toner supply orifice and a further, restricted orifice which is of a size such as to minimise turbulence in the toner as it is being withdrawn.

6. A method according to claim 2, wherein the toner is removed from said region by suction.

7. A method according to claim 6, wherein a vacuum pump is used to provide said suction.

8. A method according to claim 1 wherein the electrophotographic film is supported at a distance in the range from 0.01 to 2.00 mm from said electrode surface.

9. A method according to claim 8, wherein the electrophotographic film is supported at a distance in the range from 0.2 to 1 mm from said electrode surface.

10. A method according claim 1 wherein liquid toner is supplied to said toner supply orifice via a flow channel which incorporates a metering cylinder, and wherein the predetermined quantity of toner is delivered by moving a piston within said metering cylinder.

11. A method according to claim 1, wherein the electrode is formed with a single toner supply orifice.

12. A method according to claim 11, wherein the liquid toner is supplied through a plurality of small apertures arranged in a closely pitched linear array on said electrode surface.

13. A method according to claim 1, wherein the flow of liquid toner into said region is effected at a flow rate sufficiently low to minimise turbulence.

14. An assembly for the application of a liquid toner to an electrostatic image, which comprises:

an electrode having a flat surface defining a toner supply orifice;

means for supplying a predetermined quantity of liquid toner through said supply orifice; and support means for supporting an electrophotographic film at a predetermined distance from said flat surface to receive said predetermined quantity of liquid toner, the support means defining flow channels bounding said electrode which allow air to flow into and out of the region which contains liquid toner when liquid toner passes through said orifice whereby said metered quantity of liquid toner is held in position on said electrophotographic film by surface tension forces and out of contact with said support means.

15. An assembly as claimed in claim 14, in which the support means comprises a support surface defining a recess in which is positioned the electrode, such that a film supported by the surface is supported at a distaine from said flat surface of the electrode in the range of from 0.2 to 1.0 mm.

16. An assembly as claimed in claim 14 wherein said flat surface of the electrode is constituted by a replaceable layer applied to the main body of the electrode.

17. Apparatus for processing an electrostatic image, which comprises a support surface for an electrophotographic film which is to be processed, and an assembly as claimed in claim 14.

18. Apparatus as claimed in claim 17 wherein said assembly is positioned in a recess formed in the support surface, so that a film supported by said surface will be held apart from the flat surface of the electrode of said assembly by a distance in the range 0.2 to 1.0 mm.

* * * * *